United States Patent [19]

Daidone

[11] 4,058,860

[45] Nov. 22, 1977

[54] SUSPENDED BED WITH HEIGHT CONTROL

[76] Inventor: Kenneth Daidone, 317 - 100th St., Brooklyn, N.Y. 11209

[21] Appl. No.: 662,586

[22] Filed: Mar. 1, 1976

[51] Int. Cl.[2] ..... A47C 13/18

[52] U.S. Cl. ..... 5/10 R; 5/83

[58] Field of Search ..... 5/10, 83, 87, 88; 312/242, 247, 306, 312

[56] References Cited

U.S. PATENT DOCUMENTS

| | | | |
|---|---|---|---|
| 67,494 | 8/1867 | Burnett | 5/10 B |
| 952,957 | 3/1910 | Sterling | 5/83 |
| 1,065,287 | 6/1913 | Welch | 5/10 B |
| 2,875,012 | 2/1959 | Riley | 312/312 |
| 3,413,051 | 11/1968 | Lundberg | 312/242 |
| 3,454,317 | 7/1969 | Salkind | 312/312 |

*Primary Examiner*—Casmir A. Nunberg
*Attorney, Agent, or Firm*—Daniel R. McGlynn

[57] ABSTRACT

An article of furniture, such as a bed, freely suspended from the ceiling of a room, including a drive motor attached thereto for adjustably controlling the relative position or height of the article of furniture with respect to the ceiling. The drive motor engages a winch which is rotatably secured to a suspending line, so that as the winch is turned by the motor, the relative position of the article of furniture with respect to the suspending point is adjustably varied.

4 Claims, 3 Drawing Figures

SUSPENDED BED WITH HEIGHT CONTROL

BACKGROUND OF THE INVENTION

The invention relates to articles of furniture, such as chairs, sofas, tables, and beds, and more particularly to such articles of furniture that are suspended from the ceiling of a room.

Although various types of adjustable furniture are known in the prior art, such furniture is concerned with the adjustment of integral portions thereof for the purpose of the comfort of the individual user of the piece of furniture. Except for "convertible" type furniture, little consideration has been given to the problem of adjusting the location of the piece of furniture relative to the room in which the furniture is located.

SUMMARY OF THE INVENTION

It is an object of the invention to provide an article of furniture whose relative position in a room is automatically adjustable.

It is another object of the invention to provide a suspended support whose relative position with respect to the ceiling is adjustably controllable.

It is still another object of the invention to provide an article of furniture which is adjustably suspended from the ceiling of a room, and including means for automatically adjusting the relative position of the article of furniture with respect to the ceiling.

It is yet another object of the invention to provide a bed which is freely suspended from the ceiling of a room by means of supporting lines, and including means for changing the length of the supporting lines, thereby changing the relative position of the bed with respect to the ceiling.

The invention is concerned with a novel and improved bed which is freely suspended from the ceiling of the room by means of pulleys releasible attached to hooks fixedly secured to the ceiling.

The invention is further concerned with an article of furniture including a support, suspension lines fixedly secured to the support and engaging a pulley secured to the ceiling, and means for changing the length of the suspension line between the support and the ceiling.

Another broad aspect of the invention is concerned with a support, freely suspended from the ceiling of a room by means of suspension lines engaging a pulley secured to the ceiling, the lines also engaging a winch attached to the support, and means for turning the winch and engaging the suspension lines, thereby changing the relative position of the support with respect to the ceiling.

BREIF DESCRIPTION OF THE DRAWING

DESCRIPTION OF THE PREFERRED EMBODIMENTS

Figure 1:
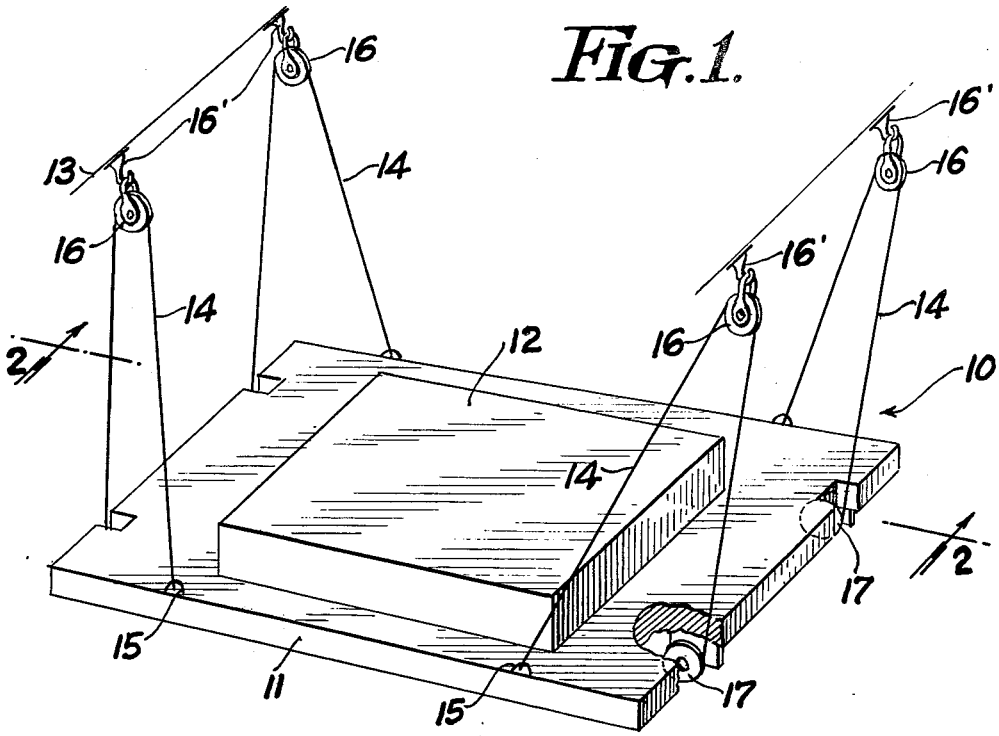
FIG. 1 is a highly simplified perspective view of an article of furniture, such as a bed, according to the present invention.

Turning now to FIG. 1, there is shown a platform or article of furniture 10. In one embodiment, the article of furniture is a bed, including a matress 12 formed of foam rubber, placed on a support 11. The support 11 may be constructed of plywood, honeycombed aluminum sheet, or other lightweight materials capable of supporting the intended loads.

The platform 10 is adapted to be suspended from the ceiling of the room at a predetermined height. It is one of the important features of the invention that this predetermined height be continuously adjustable by an operator on the platform 10 itself.

The platform 10 is freely suspended from the ceiling 13 by means of supporting or suspending lines 14. In the preferred embodiment the lines 14 consist of ½-inch nylon rope. One end of the line 14 is fixedly secured to the platform 10 by means of clamp attachment 15. In the preferred embodiment there are four such attachments 15 arranged along the periphery of the platform 10. In the case of a platform 60-inches by 80-inches in size, it has been found satifactory to locate the attachments 17 to 18 inches from the corners along the longer side of the platform, as shown in FIG. 1.

Each of the suspension lines 14 extends upwardly from its respective attachment 15 to a pulley 16 attached to the ceiling 13 by means of a hook 16'. The hook 16' is permanently and securely fixed to the ceiling 13 to enable the entire weight of the platform 10 and its load to be supported. The pulley 16 is releasibly attached to the hook 16' to permit simple assembly and construction of the suspended platform according to the present invention.

Each of the suspension lines 14 rotatably engages the respective pulley 16 and suspends the platform 10 therefrom. The suspension lines 14 also extend downwardly from the pulley 16 to a cut-out 18 on the edge of the platform 10 to a second connection to the platform 10. A cut-away view is shown on the right hand portion of FIG. 1 indicating a pulley 17 located beneath the cut-out 18 on the underside of the platform 10 with respect to the ceiling, for rotatably engaging the suspension line 14 and guiding it therewith along the underside of the platform 10. The pulley 17 therefore serves as a second connection point for the suspension line 14 to the platform. In the embodiment shown in FIG. 1, there are four suspension lines 14, and four respective suspension pulleys 16 located on the ceiling 13. There are four fixed attachments 15 on the platform 10, and four rotatable connection points, such as the pulleys 17 on the underside of the platform 10. The suspension pulleys 16 are laid out rectangular fashion, corresponding to the rectangular shape of the platform 10. Two of the fixed attachments 15 are located on one side of the platform 10, while the remaining two fixed attachments 15 are located on the opposed side of the platform 10. Correspondingly, two of the pulleys 17 are located on another side of the platform 10, while the remaining two pulleys 17 are located on the opposite side thereof (not shown in FIG. 1).

Figure 2:
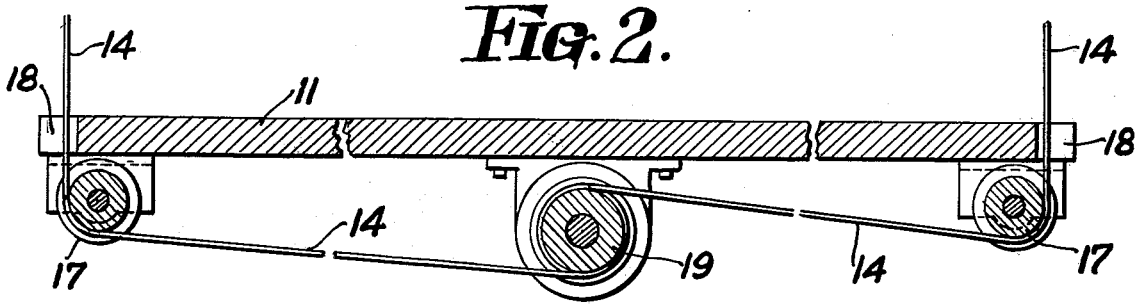
FIG. 2 is a cross-sectional view of the article of furniture according to the present invention through the AA plane.
Figure 3:
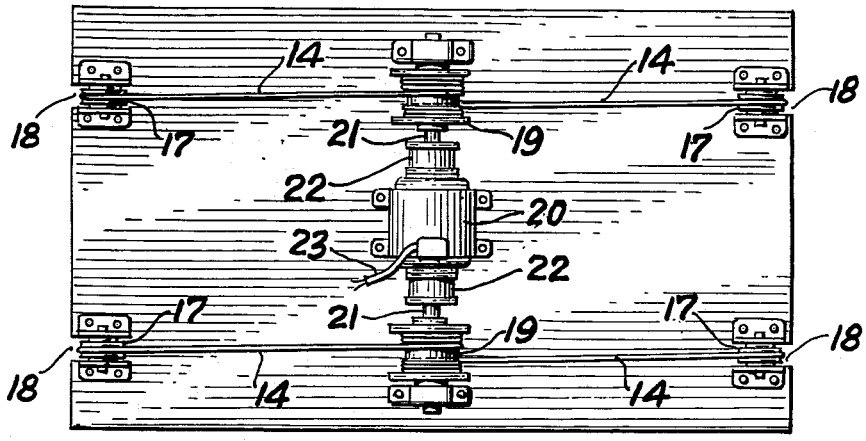
FIG. 3 is a direct view of the underportion of the support according to the present invention.

Turning now to FIG. 2, there is shown a cross-section of the platform through the AA plane indicated in FIG. 3. The pulleys 17 are fully shown on the underportion of the platform 10, and the suspension lines are shown rotatably engaging the respective pulleys 17 and extending along the underside of the platform 10 through a winch 19. The suspension lines 14 rotatably engage the winch 19 in opposed directions, so that as the winch 19 is turned in a given direction, each of the suspension lines 14 are either both drawn into the winch 19, or released from the winch 19. The effect is, therefore, that as the winch 19 is turned, the length of the suspension lines 14 between the pulleys 17 and the suspension pulleys 16 are changed, thereby changing the relative position of the platform 10 with respect to the ceiling 13 in a uniform manner.

Turning now to FIG. 3, there is shown a direct view of the underside portion of the platform 10. The cutouts 18 in the two opposed sides of the platform 11 are shown, with respective pulleys 17 located adjacent to the cutouts 18 for receiving an rotatably engaging the four corresponding suspension lines 14. The suspension lines 14 are shown extending along the platform in a substantially straight line to two respective winches 19 located midway between the two opposed sides of the platform 11. At the center of the underside of the platform 10 is a drive motor 20, which is fixedly secured to the underside of the platform 11. The drive motor 20 has two opposed shafts 21 which rotate in the same direction and engaged thw two winches 19. The suspension lines 14 are connected to and rotatably engage the winches 19 in the matter shown in FIG. 3. The drive motor 20 is actuatable by an operator (such as by a switch, not shown) located on the platform 11 for rotating the two winches 19 simultaneously, thereby either drawing the suspension lines onto the winches 19, thus decreasing the length of the suspension line between the platform and the suspension points on the ceiling; or releasing the suspension lines 14 from the winches 19, thus increasing the length of the suspension line between the said platform 11 and the ceiling 13. The net effect of rotation of the shaft 21 and the winches 19 by the motor 21 is therefore to change the relative position of the platform 11 which respect to the ceiling 13 in a continuous and uniform manner under operator control from the platform. Because of the arrangement of suspension lines, the platform remains substantially parallel to the ceiling throughout its course of motion.

When the motor 20 is stopped, the winches 19 lock, thereby fixing the platform 10 at a predetermined distance from the ceiling.

Also shown in FIG. 3 are gear reduction means 22 located between the drive motor 20 and the shafts 21. The gear reduction means reduces the speed of the shaft of the motor to a suitable speed for rotating the winches 19.

Attached to the motor 20 is a power cord 23 for connection of a switch (not shown). The switch is accessible to an operator on the platform, and is operated for energizing the motor 20 to turn the shafts 21 in either direction, i.e. to raise or lower the platform.

Without further analysis, the foregoing will so fully reveal the gist of the present invention that others can, by applying current knowledge readily adapt it for various applications without omitting features that, from the standpoint of prior art, fairly consistutes essential characteristics of the generic or specific aspects of this invention and, therefore, such adaptions should and are intended to be comprehended within the meaning and range of equivalence of the following claims.

What is claimed as new and desired to be protected by Letters Patent is set forth in the appended claims.

The Bottom of the bed platform may be covered, and when raised to its uppermost position may align with a false or "drop" ceiling, thus creating the illusion of a plane ceiling. The switch (not shown) will hang from the drop ceiling, and the platform may be lowered by actuating the switch.

I claim:

1. A suspended article of furniture comprising a bed platform including resilient support means located on one side thereof for supporting a load thereon;

a suspension line connected to said bed platform at a first point, and to a ceiling at a second suspension point, for freely suspending said platform from the ceiling;

guiding means located on the underside of said platform with respect to the ceiling comprising cutouts in said platform for receiving said suspension line, and pulleys, each of said pulleys located adjacent a respective one of said cut-outs for rotatably engaging said suspension line extending through said respective one cut-out and guiding said suspension line along the underside of said platform parallel one side thereof, at least two of said pulleys being located adjacent one side of said platform, and two of said pulleys located adjacent the opposite side of said one side of said platform;

a suspending pulley releasibly attached to said second suspension point, said suspension line rotatably engaging said suspending pulley for suspending said bed platform therefrom; and means connected to said bed platform for changing the length of said suspension line between said first point and said second point for changing the relative height of said platform with respect to the ceiling, comprising a drive motor fixedly secured to the underside of said bed platform with respect to the ceiling, rotatably engaging said suspension line and actuatable for drawing said suspension line with respect to said second point, thereby changing the length of said suspension line between said bed platform and said second point.

2. The article as defined in claim 1 wherein said platform is rectangular.

3. The article as defined in claim 1, wherein said platform is suspended by four said suspension lines, and said means connected to said bed platform comprise two winches located on the underside of said platform with respect to said ceiling, each of said winches rotatably engaging two of said suspension lines for simultaneously changing the length of said suspension lines between said platform and said ceiling.

4. The article as defined in claim 3, further comprising means located on the underside of platform, simultaneously rotatably engaging said two winches, and actuatable by a user on said platform for rotating said two winches in a predetermined direction.

* * * * *